US005938336A

United States Patent [19]

King

[11] Patent Number: 5,938,336

[45] Date of Patent: Aug. 17, 1999

[54] CONVERTIBLE CARRYALL BAG AND METHOD OF PRODUCING SAME

[75] Inventor: Peter M. King, Madison, Wis.

[73] Assignee: KingKraft, Inc., Madison, Wis.

[21] Appl. No.: 08/923,356

[22] Filed: Sep. 4, 1997

[51] Int. Cl.[6] ..... B65D 30/00

[52] U.S. Cl. ..... 383/4; 383/16; 383/38; 224/42.11

[58] Field of Search ..... 383/4, 16, 38, 383/39, 190, 224, 5, 297; 190/1, 2; 224/575, 42.11; D3/231; 5/417; 297/118, 129, 188.01, 188.2, 217.1, 217.7

[56] References Cited

U.S. PATENT DOCUMENTS

| | | | |
|---|---|---|---|
| 271,540 | 1/1883 | Strubbe | 224/42.11 X |
| 424,354 | 3/1890 | Marshall | 224/42.11 X |
| 2,865,433 | 12/1958 | Warner . | |
| 3,041,638 | 7/1962 | Lo Vico | 383/4 X |
| 3,763,972 | 10/1973 | Karzmar | 383/4 X |
| 3,947,903 | 4/1976 | Menke . | |
| 4,156,446 | 5/1979 | Nathan . | |
| 4,273,380 | 6/1981 | Silvestri . | |
| 4,296,788 | 10/1981 | Slater . | |
| 4,468,810 | 8/1984 | Longo . | |
| 4,469,363 | 9/1984 | Kalla . | |
| 4,553,785 | 11/1985 | Duke, Jr. et al. . | |
| 4,606,070 | 8/1986 | Schachter | 383/4 |
| 4,626,015 | 12/1986 | Kruyt . | |
| 4,781,277 | 11/1988 | Lim . | |
| 4,863,003 | 9/1989 | Carter | 383/4 X |
| 4,950,014 | 8/1990 | Smith . | |
| 4,991,245 | 2/1991 | Franco . | |
| 5,120,108 | 6/1992 | Watson et al. . | |
| 5,178,310 | 1/1993 | Sowerby | 224/153 |
| 5,275,463 | 1/1994 | Rocha . | |
| 5,413,198 | 5/1995 | Ferris . | |
| 5,439,154 | 8/1995 | Delligatti . | |
| 5,467,487 | 11/1995 | Sicard . | |
| 5,581,829 | 12/1996 | Lee | 224/42.11 X |
| 5,615,769 | 4/1997 | Stephenson . | |
| 5,620,229 | 4/1997 | Ledford . | |
| 5,622,300 | 4/1997 | Robinson . | |

FOREIGN PATENT DOCUMENTS

| | | | |
|---|---|---|---|
| 439420 | 7/1991 | European Pat. Off. | 383/4 |

*Primary Examiner*—Jes F. Pascua

[57] ABSTRACT

The present invention disclosed a lightweight, flexible and machine washable convertible organizer tote bag that has three basic carrying portions—a central U-shaped or sling compartment and two side storage panels on either side thereof. The bag also readily converts from its tote bag conformation to a seat cover for use on chairs, chaises, and the like. When configured as a seat cover and placed on the horizontal seat of a chair, chaise, or the like, the side panels extend downward such that each pocket of the combination is positioned for convenient accessibility at the side of the seat. The seat cover easily and conveniently converts into an organizer tote bag by lifting the handles.

21 Claims, 5 Drawing Sheets

CONVERTIBLE CARRYALL BAG AND METHOD OF PRODUCING SAME

BACKGROUND OF THE INVENTION

This invention relates to a convertible carryall bag for easy and convenient transport of various items, and is also suitable as a seat cover.

Every day people travel to school, work, office, beaches, parks, etc., taking along, out of necessity, for convenience, or for comfort, various articles. Keeping them organized can be a nuisance. Thus, the journey itself is often made unpleasant by the task of transporting disorganized, sometimes bulky, items.

Carrying bags and tote bags of all types are well known in the art and are continually being changed and adapted to meet the changing needs of users. See, e.g., U.S. Pat. No. 4,468,810 issued to Longo for a convertible carrying bag and U.S. Pat. No. 4,156,446 issued to Nathan for a tote bag.

Still other prior art devices include combinations of carrying bag and other functionalities. For example, U.S. Pat. No. 2,865,433 issued to Warner, discloses a combination stadium seat cushion and article carrier, consisting of a pair of seat cushions hinged to a carrying bag. U.S. Pat. No. 5,120,108 issued to Watson, et al., shows a convertible seat, equipment holder, and ice skate protector device. U.S. Pat. No. 4,553,785 issued to Duke, et al., discloses a terry cloth cover, with inwardly facing pockets to fit snugly over the head and leg ends of such a chair. U.S. Pat. No. 5,275,463 issued to Rocha reveals a similar terry cloth device having a hooded portion that slips over the head end of a lounge-chair and lateral straps with which to secure it to the foot end, as well as a head pocket and two hanging side pockets. U.S. Pat. No. 5,620,229 issued to Ledford discloses a combination lounge-chair cover, carrying bag, and accessory storage device with side pockets. U.S. Pat. No. 4,273,380 issued to Silvestri discloses an absorbent towel with a self-storing pocket that may cover the back and seat portions of a chaise lounge chair. U.S. Pat. No. 4,991,245 issued to Franco discloses a portable pillow and beach blanket or towel that converts into a self-storing tote bag. U.S. Pat. No. 5,467,487 issued to Sicard shows a terry cloth towel with a storage area at one end that may function as a duffel bag as well as encase an inflatable pillow and a flip-out pouch. U.S. Pat. No. 5,622,300 issued to Robinson relates to a roll pack that may function as a blanket or towel, and has storage pockets at either end to be converted into a carrying device.

Notwithstanding the prior attempts to provide carryall or tote bags, a need still exists for a product that organizes and carries all the user's desired items and that can accommodate various sized and shaped items in a carrying compartment as well as smaller sized items in neat pockets.

BRIEF SUMMARY OF THE INVENTION

The present invention provides a convertible carryall or tote bag. The tote feature of the present invention provides for carrying both larger items, such as a towel, blanket, change of clothes, snorkel and fins, etc., and smaller items, such as keys, money, sunglasses, sun tan lotion, sun screen, reading material, papers, writing utensils, portable phone or radio, snacks, drinks, sandals, etc., to school, work, office, and for leisure or recreational activities. The tote feature thereby eliminates the need to carry multiple bags to and from the desired destination while easing the inconvenience and annoyance of carrying disorganized supplies and personal accessories. In an illustrated embodiment, the tote bag includes three basic carrying portions—a central U-shaped or sling compartment which can accommodate larger items and two side storage compartments in either side thereof which can accommodate smaller items.

At the same time, the present invention can be converted from the convenient carryall organizer tote form into a comfortable and sanitary seat cover that holds the user's belongings in position for convenient accessibility at the sides of the seat.

More specifically, the present invention provides a convertible organizer tote bag which includes: a main panel, a pair of side storage compartments, a pair of handles, and a closure. The main panel comprises an elongate flexible sheet material which has a pair of opposing longitudinal edges and a pair of opposing lateral edges.

Each side storage compartment defines an elongate first side pocket and is integrally attached to and extends from one of the lateral edges of the main panel. Each side storage compartment has an inner surface and an outer surface, and includes a first edge co-linear with one lateral edge of the main panel, a second edge parallel to and spaced apart from the first edge, and a pair of side edges between the first and second edges. Each side storage compartment also has at least one outer panel attached to the outer surface of the side storage compartment. Each outer panel defines at least one second side pocket.

Each handle includes a loop strap having opposed ends affixed to one of the lateral edges of the main panel, such that when the handles are grasped in registry with each other, each handle acts as a hinge to allow the side storage compartments to fall outward while drawing together the lateral edges of the main panel to form a central carrying compartment. The closure is reclosable and connects one lateral edge of the main panel to the other lateral edge of the main panel.

The organizer tote bag of the present invention is configured so that when placed on a seat of a chair, the side storage compartments extend downward such that each pocket of the bag is positioned for convenient accessibility at the side of the seat. In a preferred embodiment, the main panel and side storage compartments are made of a soft, flexible, machine washable material. Moreover, in the preferred embodiment, each of the first and second pockets additionally includes a resealable closure. Additionally, the pair of handles may be adjustable, such that their length can be adjusted by the user.

In another aspect, the invention also provides a method for manufacturing the convertible organizer tote bag.

While the present invention has now been described and exemplified with some specificity, those skilled in the art will appreciate the various modifications, including variations, additions, and omissions, that may be made in what has been described. Accordingly, it is intended that these modifications also be encompassed by the present invention and that the scope of the present invention be limited solely by the broadest interpretation that lawfully can be accorded the appended claims.

BRIEF DESCRIPTION OF THE DRAWING(S)

The preferred exemplary embodiment of the present invention will hereinafter be described in conjunction with the appended drawings wherein like designations refer to like elements throughout and in which.

DETAILED DESCRIPTION OF THE INVENTION

This invention relates generally to a device for easy and convenient transport of items to, e.g., school, work, the office, recreation and other related destinations. In particular, this invention relates to a convertible organizer tote bag that presents itself as a neat, organized carryall which can also be used as a seat cover. The present invention is most particularly adapted for use in organizing and carrying all varieties of items, from larger items, such as a towel, blanket, change of clothes, files, chairs, to smaller items, such as keys, money, sunglasses, sun tan lotion, sun screen, reading material, papers, writing utensils, portable phone or radio, snacks, drinks, sandals. Accordingly, the present invention will now be described in detail with respect to such endeavors; however, those skilled in the art will appreciate that such a description of the invention is meant to be exemplary only and should not be viewed as limiting the full scope thereof.

Figure 1:
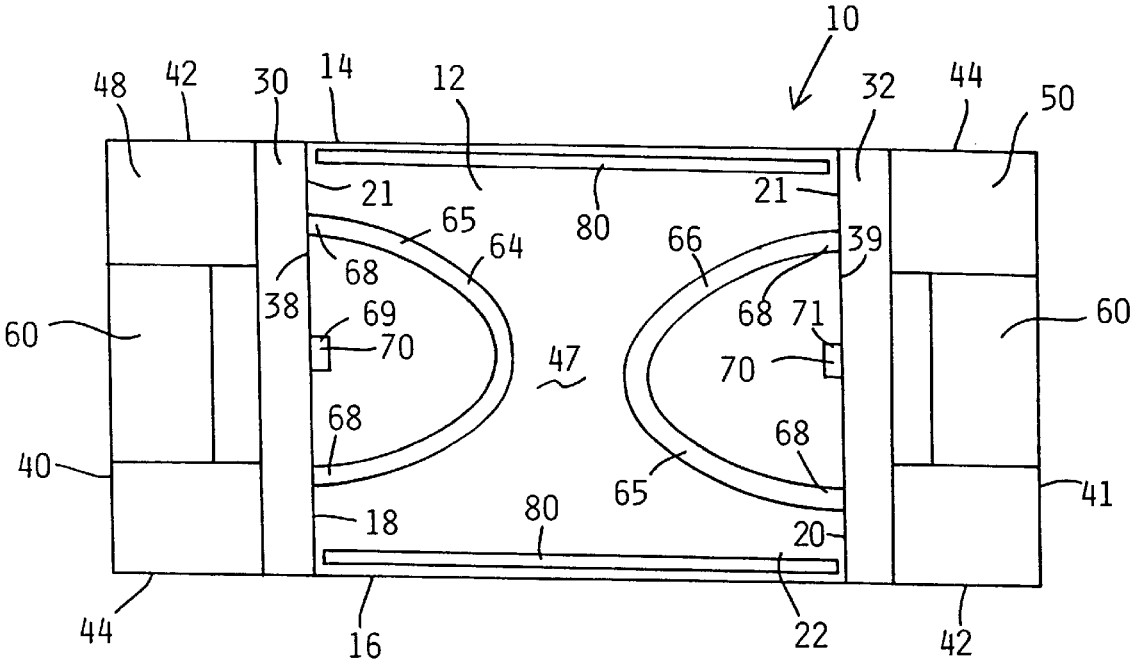
FIG. 1 is a top view of the organizer tote bag of the present invention in a flat, open conformation.
Figure 2:
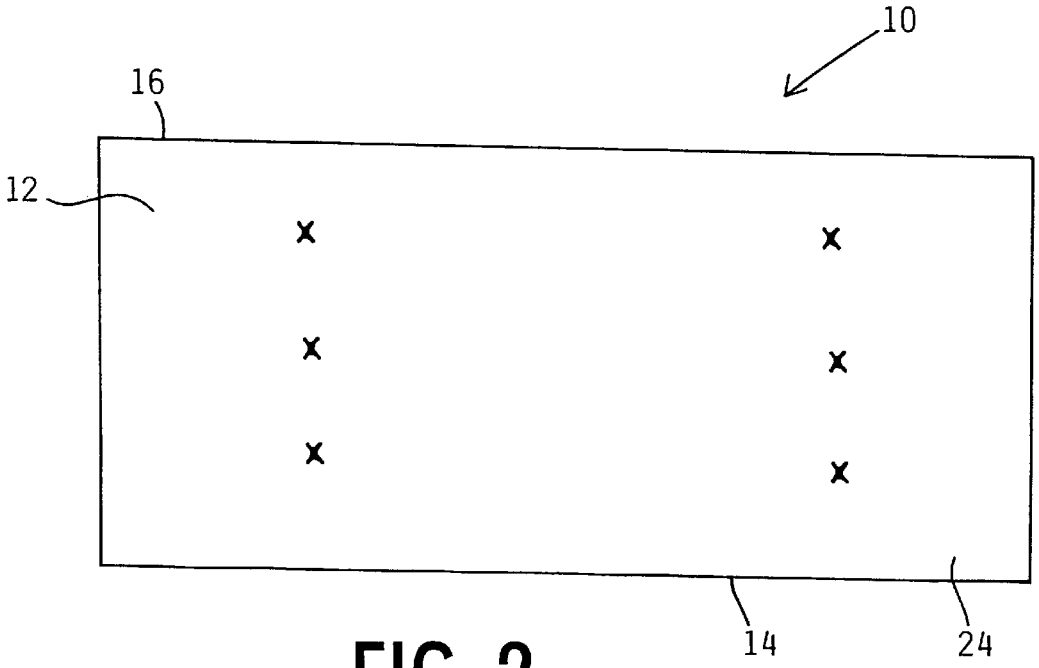
FIG. 2 is a bottom view of the organizer tote bag of the present invention in a flat, open conformation.
Figure 4:
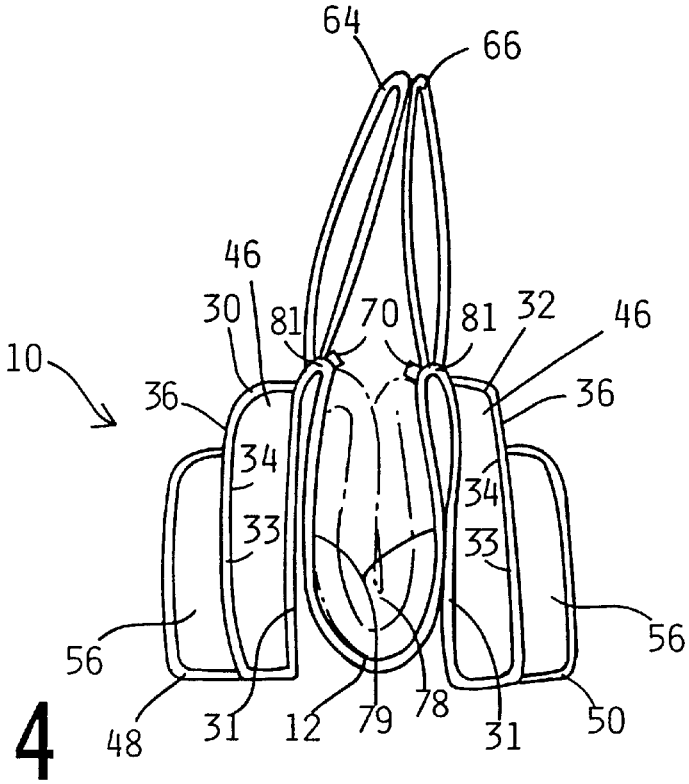
FIG. 4 is an end view of the organizer tote bag of the present invention in a tote bag conformation.

Reference is initially made to FIGS. 1 and 4 wherein a convertible organizer tote bag 10 in accordance with the present invention is illustrated. Organizer tote bag 10 includes a main panel 12 and two side storage compartments, i.e., a first side panel and a second side panel, each of which includes one or more pockets. Main panel 12 has a first longitudinal side edge 14 and an opposing second longitudinal side edge 16; and a first lateral side edge 18 and an opposing second lateral side edge 20. Main panel 12 also has a top surface 22, and a bottom surface 24, as shown in FIGS. 1 and 2, respectively.

Main panel 12 is generally a rectangular sheet of material, the size of which is conveniently that of the seat portion of a chair or chaise. Main panel 12 is preferably constructed of a flexible fabric which is water repellent, mildew resistant, color fast and fade resistant; furthermore the material preferably has high tensile strength, satisfactory scratch and tear resistance, low porosity, low permeability, and is durable. Such materials include a wide variety of fibrous, leather and human made materials. These include, but are not limited to, cotton cloth, cotton blends, oxford cloth, flannel cloth, quilted cloth, canvas cloth, terry cloth or other blanket or towel material, leather, rayon, nylon and other polymeric materials. Additionally, such material may be coated with a suitable polymeric material such as polyurethane.

Figure 5:
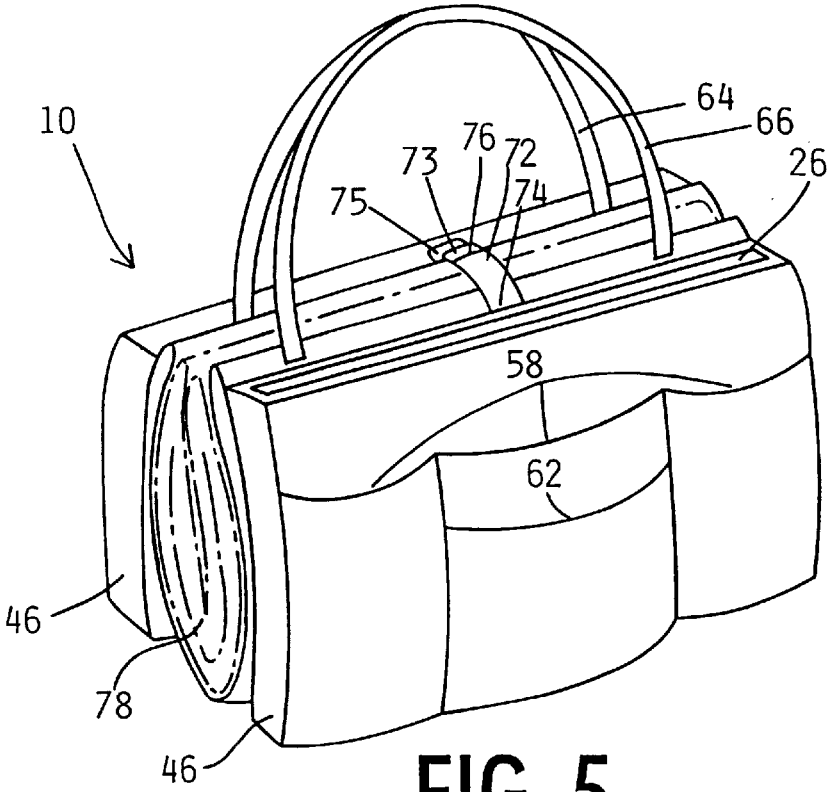
FIG. 5 is a side perspective view of the organizer tote bag of the present invention in a tote bag conformation.
Figure 6:
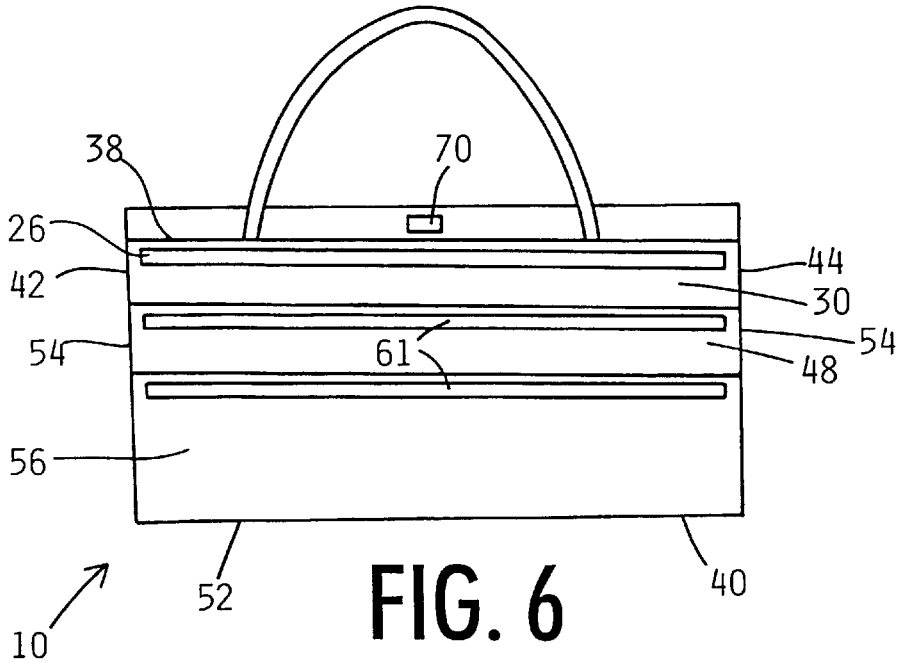
FIG. 6 is a side view of the organizer tote bag of the present invention in a tote bag conformation.
Figure 7:
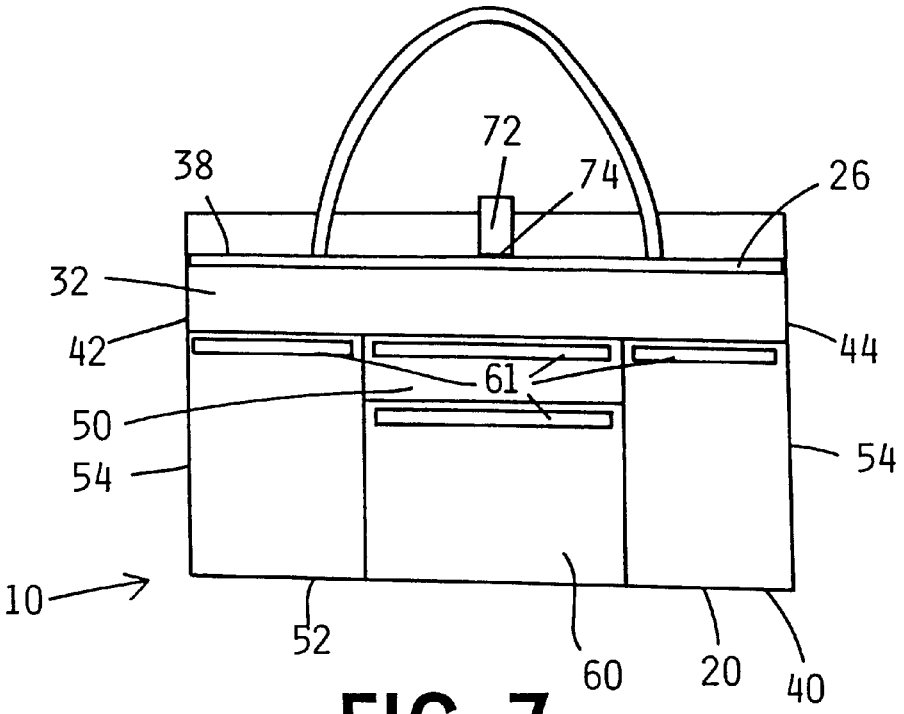
FIG. 7 is a side view of an alternative embodiment of the organizer tote bag of the present invention in a tote bag conformation.

Each side compartment 30 and 32, respectively, includes an inner panel 31 and an outer panel 33, and each outer panel 33 has an inner surface 34 and an outer surface 36, as shown in FIG. 4. Inner panel 31 of side compartment 30 includes a first edge 38, as illustrated in FIGS. 1 and 6. First edge 38 of side compartment 30 is co-linear with the first lateral side edge 18 of the main panel 12, and integrally attached thereto. Inner panel 31 of side compartment 32 includes a first edge 39 which is co-linear with second lateral side edge 20 of the main panel 12, and integrally attached thereto, as shown in FIGS. 1, 6 and 7. Each inner panel 31 of each of the side compartments 30 and 32 additionally comprises a second edge 40 and 41, respectively, parallel to and spaced apart from the first edges 38 and 39, respectively. Each of side compartments 30 and 32 also includes a pair of side edges 42 and 44, such that the inner surface 34 of inner panel 31, together with outer panel 33, form an elongate first side pocket 46, as shown in FIGS. 4 and 5. Each first pocket 46 is adapted to hold a wide variety of items as desired by the user.

The integral attachment edges of side compartments 30 and 32 and main panel 12 may be by any suitable means, including, but not limited to, sewing, riveting and thermal fusing. Alternatively, the side compartments 30 and 32 may be a continuous piece of material with the main panel 12. The main panel 12 and inner panels 31 would be integral and would constitute one piece of material which would also include outer panels 33. In other words, a single piece of elongate material could be folded on either end to form the two side compartments 30 and 32. The side compartments 30 and 32 may be constructed from the same, similar, or contrasting material as previously described for the main panel 12.

Figure 3:
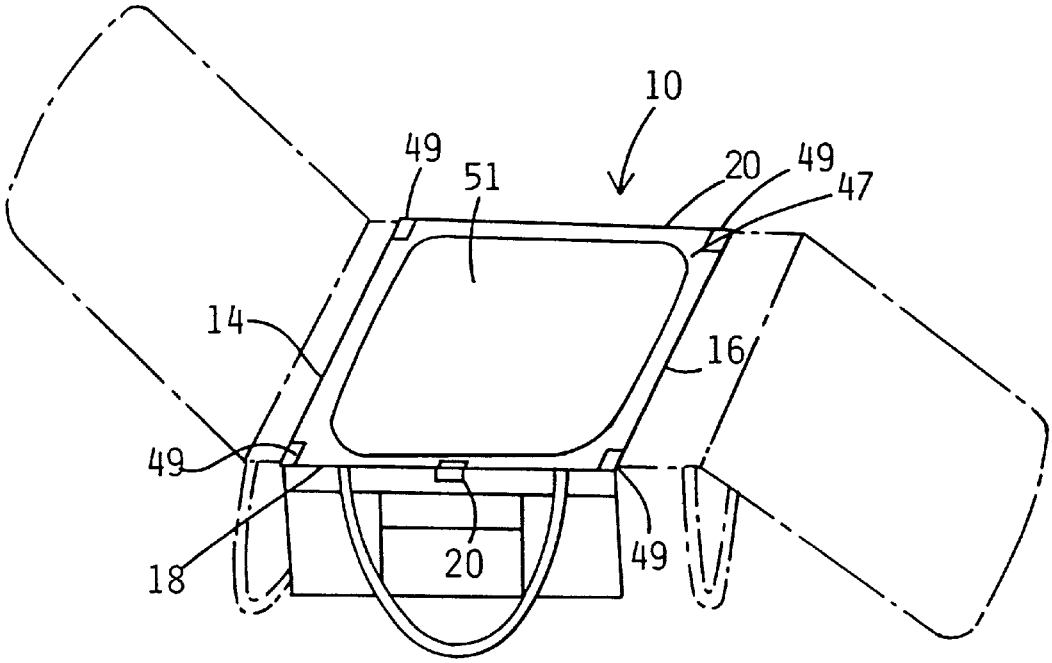
FIG. 3 is a top perspective view of the organizer tote bag of the present invention in a seat cover conformation.

FIG. 3 illustrates the use of convertible tote bag 10 as a seat cover. Main panel 12 includes a midportion 47 which is defined by opposed lateral edges coincident with opposed lateral edges 18 and 20 of main panel 12. In use, midportion 47 covers the seat of a chair or chaise with edges 18 and 20 substantially superposed respectively on the side edges of the chair seat. Side compartments 30 and 32 hang over the chair seat side edges. It is also noted that the size of midportion 47 can be adjustable to any size seat by providing fasteners 49 which will shorten longitudinal edges 14 and 16, e.g., Velcro®.

Optionally, midportion 47 of main panel 12 suitably may include a padded cushion 51, as shown in FIG. 3. The cushion 51 is preferably soft, flexible and machine washable, as is entire organizer tote bag 10. Cushion 51 may be constructed from materials such as, including, but not limited to, polymeric foam, cotton batting, polymeric batting, rubber and other similar materials.

Figure 8:
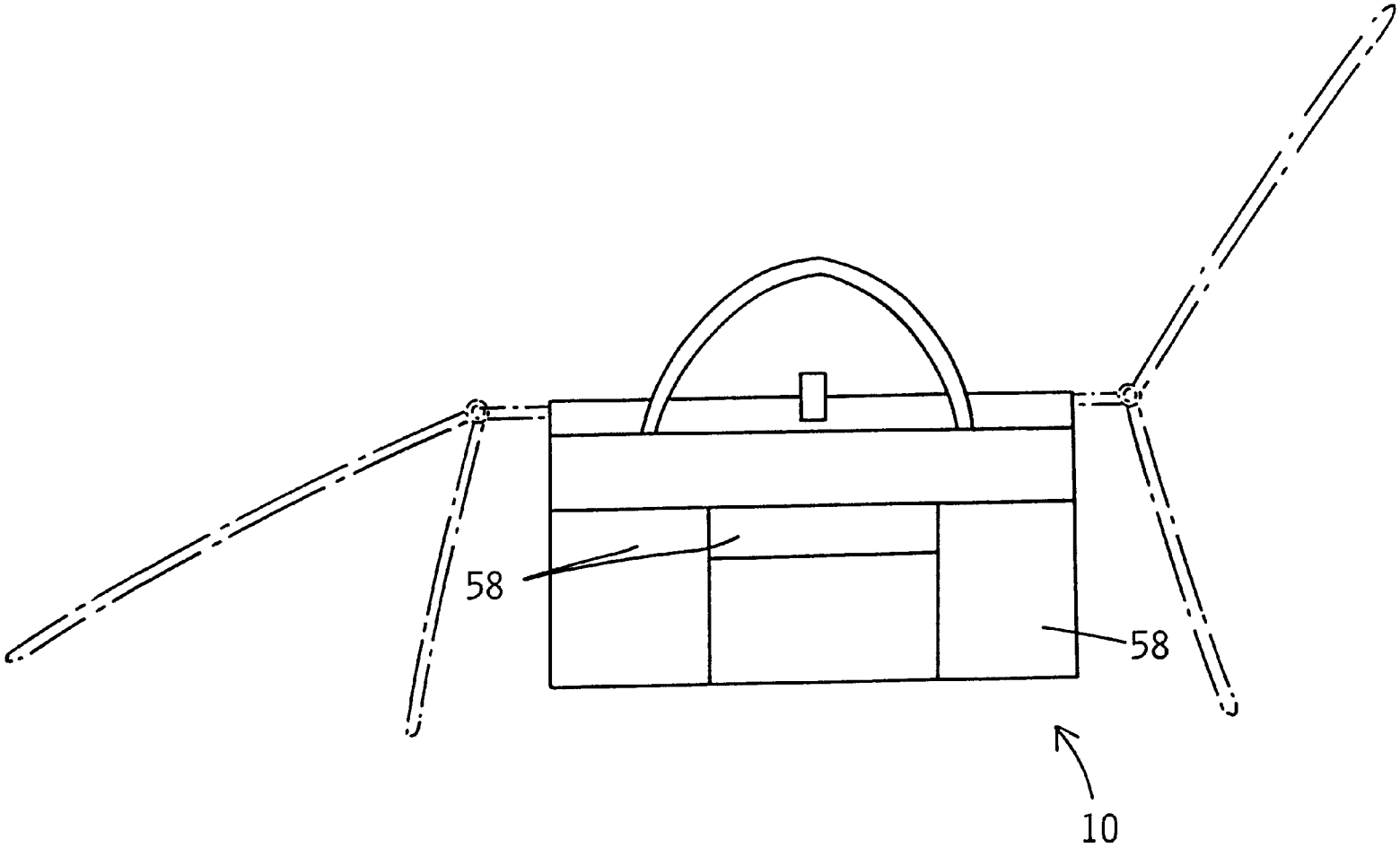
FIG. 8 is a side view of the organizer tote bag of the present invention in a seat cover confirmation.

Each of the side compartments 30 and 32 is constructed in such a way as to hang above the ground when tote bag 10 is used in the seat cover configuration as shown in FIGS. 3 and 8. Side compartments 30 and 32, as well as the user's possessions therein, are, thus, kept clean, dry, safe and above the ground. This may be achieved by assuring that the lengths of the side edges 42 and 44, together with longitudinal side edges 14 and 16 of the main panel 12, do not exceed the width plus the height of the desired chair or chaise. Each first pocket 46 suitably includes an optional reclosable fastener 26, as shown in FIGS. 5 and 6. Each first pocket 46 may also be pleated to accommodate a wider variety of larger items.

Convertible tote bag 10 also includes a second outer side panel 48, attached to the outer surface 36 of the outer panel 33 of side panel 30, and a second outer side panel 50 attached to the outer surface 36 of the outer panel 33 of side panel 32, as shown in FIGS. 1, 4, 6, and 7. Each of the outer panels 48 and 50 has a bottom edge 52 and a pair of opposing perpendicular edges 54, as shown in FIGS. 6 and 7. For outer panels 48 and 50, the bottom edge 52 and perpendicular edges 54 are permanently attached to the outer surface 36 of each of side compartments 30 and 32, respectively, by any well known means in the art, including, but not limited to: sewing, riveting and heat fusing. Each of the outer panels 48 and 50 defines a large outer pocket 56, shown in FIG. 6, or, optionally, a series of smaller outer pockets 58, shown in FIGS. 5 and 8, any or all of which may be pleated. The smaller outer pockets 58 are formed by divisions in the outer pocket 56. Such divisions may be permanent, i.e., sewn, riveted, or heat fused, or may be temporary, by means of reclosable fasteners as previously described. Each of the outer panels 48 and 50 may have identical or different pockets, as illustrated in FIGS. 6 and 7. Optionally, one or more third outer panel(s) 60 may be attached to either or both of the outer panels 48 and 50, as illustrated in FIGS. 1 and 7, to form one or more optional pockets 62, as shown in FIG. 5. Third outer panel 60 is attached in the manner previously described for outer panels 48 and 50.

Outer panels 48, 50 and 60 may be made of the same or different materials described for main panel 12. These materials include, but are not limited to: fibrous, leather, or human made materials as previously described. These materials may also include porous materials such as mesh, webbing or netting.

Pockets 56, 58 or 62 may be designed to hold any number of personal accessories such as keys, money, sunglasses, sun tan lotion, sun screen, reading material, papers, writing utensils, portable phone or radio, snacks, drinks, sandals, articles of clothing, and other similar items. Pockets 56, 58 or 62 may each optionally include a resealable closure 61, as illustrated in FIGS. 6 and 7.

Each edge of the first pocket 46, of outer pocket 56, of smaller outer pockets 58, and/or of optional pockets 62 may be finished with optional trim 63. Such trim may be comprised of any suitable material known in the art, including, but not limited to: seam bias tape, rickrack, fabric, and cord.

Convertible organizer tote bag 10 further includes a first handle 64 and a second handle 66. Each handle 64 and 66 suitably includes a loop strap 65 having opposing ends 68, as shown in FIG. 1. Each of the opposing ends 68 of first handle 64 is affixed to lateral edge 18, as illustrated in FIGS. 1 and 2. Each of the opposing ends 68 of second handle 66 is attached to lateral edge 20, shown in FIGS. 1 and 2, such that handles 64 and 66 can be suitably positioned in registry with each other when in the tote bag conformation, as shown in FIGS. 4 and 5. Each of handles 64 and 66 is securely and permanently attached by any means commonly known in the art, including, but not limited to, sewing, riveting and heat fusing. The handles 64 and 66 may be made of any suitable material known in the art, including, but not limited to, webbed strapping, cord, rope, chain, leather and plastic.

A unique feature of convertible organizer tote bag 10 is the placement of handles 64 and 66 on the top surface 22 of the main panel 12 such that when handles 64 and 66 are lifted together in registry, handles 64 and 66 act as hinges to allow side compartments 30 and 32 to fall outward while drawing together lateral edges 18 and 20 of main panel 12 to form U-shaped or sling carrying compartment 78, having a pair of opposing sides 79 and a pair of opposing top edges 81 which are coincident with lateral edges 18 and 20, as best seen in FIG. 4. Compartment 78, in one embodiment seen in FIG. 4, has open sides corresponding to longitudinal edges 14 and 16 of panel 12. As such, compartment 78 can accommodate a variety of objects of varying sizes. Any object can be positioned on main panel 12, and by lifting handles 64 and 66, the object is secured in compartment 78, in a central position with the side compartments 30 and 32 and their one or more pockets on either side of compartment 78. Thus, organizer tote bag 10 includes essentially three main carrying compartments—two side compartments, each of which may include one or more pockets and a central, universal carrier. The term "universal" is meant to indicate a large variety of objects, e.g., towels, fins and snorkel, a smaller cooler, 12-packs of beverages, firewood, books, that can be carried in compartment 78 with the sides of this sling-like compartment adapting to the size.

The handles 64 and 66 may have a length suitable for hand carrying; hands-free shoulder carrying; or optionally, may be of adjustable length. The handles 64 and 66 may optionally be padded or cushioned along some or all of their lengths, for additional comfort to the user.

Convertible organizer tote bag 10 may also suitably include a third handle 63 and fourth handle 65. Handles 63 and 65 are suitably loop straps similar to handles 64 and 66 but of shorter length. Third handle 63 is attached/affixed to lateral edge 18 and fourth handle 65 to lateral edge 20. Third handle 63 is positioned midway between ends 68 of handle 64 and fourth handle 65 is positioned midway between ends 68 of handle 66. In use, each long handle 64 and 66 can be passed through the opposing short handle by which a more positive closure action is achieved.

Figure 9:
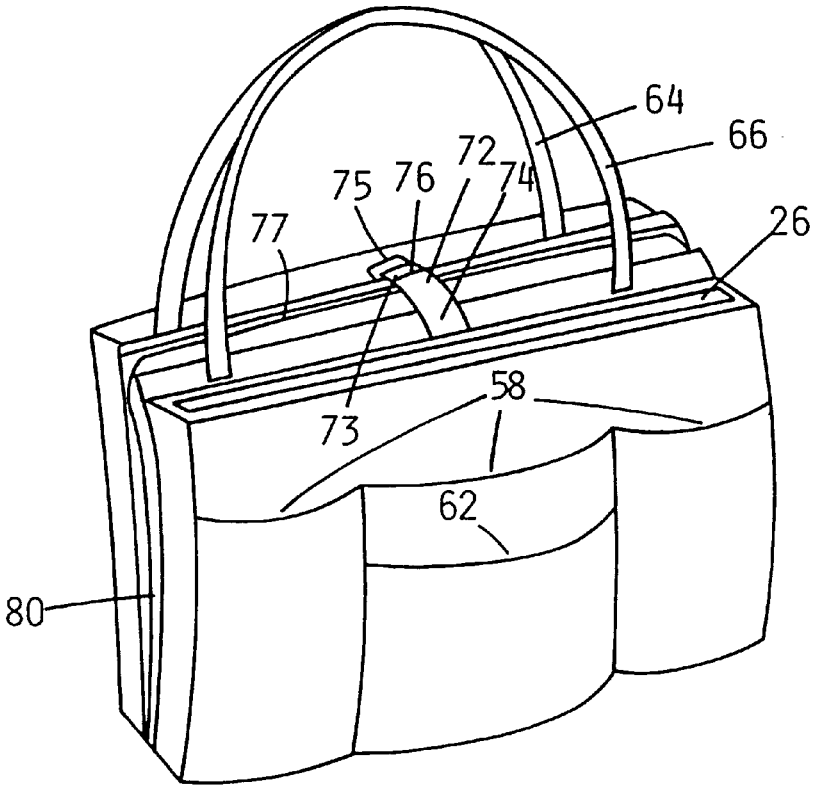
FIG. 9 is a perspective view of tote bag in accordance with the present invention, illustrating the use of side fasteners.

In an alternate embodiment, main panel 12 may include a pair of reclosable fasteners 80; one fastener 80 is located along each of longitudinal side edges 14 and 16, as shown in FIG. 1. Fastener 80 permits one-half of main panel 12 to be folded over the other half and closed on the edges, i.e., one-half of longitudinal edge 14 is fastened together with the other half. Similarly, one-half of longitudinal edge 16 is closed over the other half as best seen in FIG. 9. Reclosable fastener 80 thus allows compartment 78 to form an additional pocket 77 in which the user can more securely transport items. Reclosable fastener 80 is suitably any resealable closure, including, but not limited to, zippers, snaps, buttons, hook and eye closures, spring loaded clips and fabric hook and loop fasteners, such as Velcro®.

Additionally, convertible organizer tote bag 10 of the present invention includes a resealable closure 70, as shown in FIGS. 4 and 6. Closure 70 is suitably any standard fastener known in the art, including, but not limited to, hook and eye, button, snap, buckle and fabric hook/loop combinations such as Velcro®. One portion 69 of the closure 70 is located at lateral edge 18 of the main panel 12, with an opposite accompanying portion 71 of the closure 70 positioned in registry along the opposing lateral edge 20, as shown in FIGS. 1 and 2. Alternatively, one portion of closure 70 may be located on a flap 72, as shown in FIG. 7. The flap 72 has a first flap end 74 and a second flap end 76, as illustrated in FIG. 5. The first flap end 74 is permanently and securely attached to the lateral edge 18 as shown in FIGS. 2 and 5. The second flap end 76 holds a fastener portion 73 of closure 70, with a mate portion 75 of closure 70 attached to opposing lateral edge 20, as shown in FIGS. 5 and 9 in registry. In either embodiment of closure 70, when closure 70 is in the closed position, carrying compartment 78 is defined.

Further, optionally, main panel 12 may include central pockets 82 and 84. Pockets 82 and 84 are suitably formed by attaching a panel 86 to surface 22. Panel 86 has opposing longitudinal edges 88 and opposing lateral edges 90. Panel 86 is suitably attached to main panel 12 along longitudinal edges 88 and a center stitch line 92. Lateral edges 90 are suitably open or, optionally, may include a reclosable fastener.

Additionally, main panel 12 suitably may include one or more apertures 94 to allow passage of a sport racket handle leaving the racket head resting in compartment 78.

In summary, convertible organizer tote bag 10 is soft, flexible, lightweight, durable and machine washable. It carries and organizes a wide variety of items and can be used for school, work, and recreational activities, e.g., as a diaper bag, shopping bag, sports bag, gym bag. The organizer tote bag 10 also is conveniently convertible from its closed, tote bag conformation, shown in FIGS. 4, 5, 6 and 7, to a comfortable and sanitary seat cover, shown in FIGS. 3 and 8, that universally fits chairs, benches and chaise lounges. Similarly, bag 10 is also suitably a bedside organizer when one side panel and the main panel are secured between a mattress and box spring leaving the remaining bag conveniently hanging from the side of the bed.

While the present invention has now been described and exemplified with some specificity, those skilled in the art will appreciate the various modifications, including variations, additions, and omissions, that may be made in what has been described. For example, it is understood and within the scope of the present invention that side compartments 30 and 32 and main panel 12 may include any number of pockets of various sizes. Such pockets may be interior pockets or exterior pockets. Any pocket of organizer tote bag 10 may have flaps or any other closure mechanism. Pockets and/or compartments may also be made of netting to improve drying or weight characteristics of bag 10. Any pocket of bag 10 can be pleated to increase the size of object accommodated by the pocket. Accordingly, it is intended that these modifications also be encompassed by the present invention and that the scope of the present invention be limited solely by the broadest interpretation that lawfully can be accorded the appended claims.

I claim:

1. A convertible carryall bag, comprising:

a main panel, a pair of side storage compartments and a pair of hinge handles;

said main panel including an elongate flexible sheet material having a pair of opposing longitudinal edges and a pair of opposing lateral edges;

each of said side compartments defining a pocket and having a first edge co-linear with one of said pair of lateral edges of said main panel and a second edge parallel and spaced apart from said first edge;

one of said pair of handles hingedly attached along one of said lateral edges of said main panel between said longitudinal edges of said main panel, and the other of said pair of handles hingedly attached along the other of said lateral edges of said main panel between said longitudinal edges of said main panel, wherein when said handles are lifted and superposed in registry with each other, said main panel defines a generally U-shaped, open-ended, carrying-capacity adjustable, central carrying compartment, said side compartments disposed one on either side and external of the outside of said U-shaped central carrying compartment.

2. The bag of claim 1, further comprising a closure reclosably connecting one of said lateral edges of said main panel to the other of said lateral edges of said main panel.

3. The bag of claim 1, wherein said main panel defines a seat cover, and wherein when placed on the seat, said side compartments extend downward such that said pockets are positioned for accessibility on either side of the seat.

4. The bag of claim 1, wherein said main pane l, in a folded position defines two opposing half-portions of each said longitudinal edges, said half portions including a reclosable fastener along their lengths for fastening one half portion of longitudinal edge to the other half-portion of longitudinal edge, and thereby defining a reclosable, central pocket.

5. The bag of claim 1, wherein each said side compartments includes a plurality of pockets.

6. The bag of claim 1, further comprising a second pair of handles, one of said second pair of handles attached to one of said lateral edges of said main panel and the other of said second pair of handles attached to the other of said lateral edge of said main panel.

7. The bag of claim 1, wherein each side compartment has an inner panel and at least one outer panel attached to said inner panel on three edges to define said pocket.

8. A convertible carryall bag, comprising:

a main panel, a pair of side storage compartments and a pair of hinge handles;

said main panel including an elongate flexible sheet material having a pair of opposing longitudinal edges and a pair of opposing lateral edges;

each said side compartment defining a pocket and having a first edge co-linear with one of said pair of lateral edges of said main panel and a second edge parallel and spaced apart from said first edge;

one of said pair of handles hingedly attached along one of said lateral edges of said main panel between said longitudinal edges of said main panel, and the other of said pair of handles hingedly attached along the other of said lateral edges of said main panel between said longitudinal edges of said main panel, wherein when said handles are lifted and superposed in registry with each other, said main panel defines a generally U-shaped, open-ended, carrying-capacity adjustable, central carrying compartment, with said side compartments on either side thereof, said bag further comprising a closure reclosably connecting one of said lateral edges of said main panel to the other of said lateral edges of said main panel, wherein said closure comprises a flap and a reclosable fastener, said fastener having a fastener portion and a mate portion, said flap having opposing ends, one of said ends affixed to one of said lateral edges of said main panel between said longitudinal edges of said main panel, the other of said ends having said fastener portion of said fastener affixed to it; and said mate portion of said fastener affixed between said longitudinal edges of said main panel so as to hold said lateral edges of said main panel in registry.

9. The bag of claim 1, wherein said main panel and side compartments are made from a material selected from the group consisting of terry cloth, cotton cloth, cotton blends, flannel cloth, canvas, leather, nylon, rayon and plastic.

10. The bag of claim 1, wherein said pocket of said side compartment further comprises a reclosable fastener.

11. The bag of claim 5, wherein each of said plurality of pockets further comprises a reclosable fastener.

12. The bag of claim 8, wherein said reclosable fastener is selected from the group consisting of a hook and eye, button, snap, zipper, buckle, and fabric hook/loop combinations.

13. The bag of claim 10, wherein said reclosable fastener is selected from the group consisting of a hook and eye, button, zipper, snap, buckle, and fabric hook/loop combinations.

14. A method of constructing a convertible tote bag, the method comprising the steps of:

(a) providing a main panel comprising an elongate flexible sheet material, having a pair of opposing longitudinal edges and a pair of opposing lateral edges;

(b) providing a pair of side storage compartments, each side compartment integrally attached to and extending from one of said pair of lateral edges of said main panel, each side compartment having an inner panel and a first outer panel, each side compartment comprising a first edge co-linear and integral with one of said pair of lateral edges of said main panel, a second edge parallel to and spaced apart from said first edge, and a pair of side edges between and substantially perpendicular to said first and second edges, such that said inner panel and said first outer panel of each said side compartment define an elongate first pocket, each outer panel having a second outer panel attached to said outer surface of said first outer panel, each second outer panel defining at least one second pocket;

(c) attaching a pair of hinge handles, one of said handles affixed along one of said lateral edges of said main panel between said longitudinal edges of said main panel, the other said handle affixed along the other said lateral edge of said main panel between said longitudinal edges of said main panel, wherein when lifted, said handles are positioned in registry with each other, causing said main panel to define a generally U-shaped, open-ended, carrying-capacity adjustable, central carrying compartment, said side compartments on either side and external thereof; and (d) providing a closure, said closure reclosably connecting one of said lateral edges of said main panel to the other of said lateral edges of said main panel.

15. A method of constructing a convertible tote bag, the method comprising the steps of:

(a) providing a main panel comprising an elongate flexible sheet material, having a pair of opposing longitudinal edges and a pair of opposing lateral edges, a top surface and a bottom surface;

(b) providing a pair of side storage compartments, each side compartment integrally attached to and extending from one of said pair of lateral edges of said main panel, each side compartment having an inner panel and a first outer panel, each side compartment comprising a first edge co-linear and integral with one of said pair of lateral edges of said main panel, a second edge parallel to and spaced apart from said first edge, and a pair of side edges between and substantially perpendicular to said first and second edges, such that said inner panel and said first outer panel of each said side compartment define an elongate first pocket, each outer panel having a second outer panel attached to said outer surface of said first outer panel, each second outer panel defining at least one second pocket;

(c) attaching a pair of hinge handles, one of said pair of handles having opposing ends affixed to one of said lateral edges of said main panel between said longitudinal edges of said main panel, and the other of said pair of handles having opposed ends attached to the other of said lateral edges of said main panel between said longitudinal edges of said main panel, such that the handles, when lifted, are positioned in registry with each other, causing said main panel to define a generally U-shaped, open-ended, carrying-capacity adjustable, central carrying compartment, with said side compartments on either side and external thereof; and (d) providing a closure, said closure reclosably connecting one of said lateral edges of said main panel to the other of said lateral edges of said main panel, wherein said closure comprises a flap and a reclosable fastener, said fastener having a fastener portion and a mate portion, said flap having opposing ends, one of said ends affixed to one of said lateral edges of said main panel between said longitudinal edges of said main panel, the other of said ends having said fastener portion of said fastener affixed to it; and said mate portion of said fastener affixed between said longitudinal edges of said main panel such that said closure, when closed, holds said lateral edges in registry.

16. The method of claim 13, wherein said main panel and side panels are made from a material selected from the group consisting of terry cloth, cotton cloth, cotton blends, flannel cloth, canvas, leather, nylon, rayon and plastic.

17. The method of claim 12, wherein each of said first pockets further comprises a reclosable fastener.

18. A convertible bag, comprising a central, carrying capacity adjustable, carrying compartment, a pair of side storage compartments, one each side and external thereof, and a pair of hinge handles;

said central carrying compartment including a flexible sheet substantially in a U-shaped configuration with a pair of opposing top edges, a pair of opposing longitudinal edges, and a pair of opposing sides;

one of said pair of handles extending from one of said pair of top edges between said pair of longitudinal edges, and the other of said pair of handles extending from the other of said pair of top edges between said pair of longitudinal edges;

each said pair of side storage compartments defining a pocket.

19. The carryall bag of claim 18, wherein each of said side storage compartments includes a plurality of pockets.

20. A method of constructing a convertible tote bag, the method comprising the steps of:

(a) providing a main panel comprising an elongate flexible sheet material, having a pair of opposing longitudinal edges and a pair of opposing lateral edges, a top surface and a bottom surface;

(b) providing a pair of side storage compartments, each side compartment integrally attached to and extending from one of said pair of lateral edges of said main panel, each side compartment having an inner panel and a first outer panel, each side compartment comprising a first edge co-linear and integral with one of said pair of lateral edges of said main panel, a second edge parallel to and spaced apart from said first edge, and a pair of side edges between and substantially perpendicular to said first and second edges, such that said inner panel and said first outer panel of each said side compartment define an elongate first pocket; and (c) providing a pair of hinge handles, one of said pair of handles having opposing ends affixed to one of said lateral edges of said main panel between said longitudinal edges, the other of said pair of handles having opposed ends affixed to the other said lateral edge of said main panel between said longitudinal edges, such that the handles, when lifted, are positioned in registry with each other, causing said main panel to define a generally U-shaped, open-ended, carrying capacity adjustable central carrying compartment with said side compartments on either side and external thereof.

21. A convertible carryall bag, comprising:

a generally U-shaped, carrying-capacity adjustable, central carrying compartment, a pair of side storage compartments disposed one on either side and external thereof, and a pair of hinge handles;

said central carrying compartment including a flexible sheet material having a pair of opposing longitudinal edges, and a pair of opposing lateral edges along which said handles are attached between said longitudinal edges;

each of said side compartments having a first edge co-linear with one of said pair of lateral edges of said central carrying compartment and a second edge parallel and spaced apart from said first edge;

wherein said central carrying compartment outstretched defines a cover for a seat having side edges and said side compartments hang over said side edges, one on either side of said seat.

* * * * *